United States Patent [19]

Yano et al.

[11] Patent Number: 4,826,543

[45] Date of Patent: May 2, 1989

[54] PROCESS FOR PRODUCING HIGH TOUGHNESS, HIGH STRENGTH STEEL HAVING EXCELLENT RESISTANCE TO STRESS CORROSION CRACKING

[75] Inventors: Seinosuke Yano; Yoshihiro Okamura; Katsuo Kaku, all of Kitakyushu; Junichi Kobayashi, Sagamihara, all of Japan

[73] Assignee: Nippon Steel Corporation, Tokyo, Japan

[21] Appl. No.: 120,315

[22] Filed: Nov. 13, 1987

[30] Foreign Application Priority Data

Nov. 14, 1986 [JP] Japan ..... 61-271031

[51] Int. Cl.[4] ..... C21D 8/00

[52] U.S. Cl. ..... 148/12 F; 148/12.1; 148/12 R

[58] Field of Search ..... 148/12.4, 12 F, 12.1, 148/12 R

[56] References Cited

U.S. PATENT DOCUMENTS 4,572,748 2/1986 Suga et al. ..... 148/12 F
4,776,900 10/1988 Yano et al. ..... 148/12 R

FOREIGN PATENT DOCUMENTS 55-131126 10/1980 Japan ..... 148/12.4
61-272316 12/1986 Japan .

*Primary Examiner*—Deborah Yee
*Attorney, Agent, or Firm*—Wenderoth, Lind & Ponack

[57] ABSTRACT

A process for producing a high toughness, high strength steel having excellent resistance to stress corrosion cracking including the steps of: preparing a steel slab including 0.02 to 0.10 wt % of C, 0.50 wt % or less Si, 0.4 to 1.5 wt % Mn, 1.0 to 7.5 wt % Ni, more than 1.0 wt % up to 1.5 wt % Mo, 0.80 wt % or less Cr, 0.01 to 0.08 wt % sol. Al, and the balance of Fe and unavoidable impurities; heating the steel slab to a temperature of from 1000° C. to 1250° C.; hot rolling the heated steel slab at a finishing nip temperature of from 700° C. to 880° C., at a total reduction rate of 40% or more effected at the finishing nip temperature or lower, and at a finishing temperature of 650° C. or higher, to provide a steel plate; then quenching the steel plate by initiating water cooling at a temperature of the $A_{r3}$ point thereof or higher and by terminating the water cooling at a temperature of 150° C. or lower; and tempering the quenched steel plate at a temperature of the $A_{c1}$ point thereof or lower.

9 Claims, 5 Drawing Sheets

PROCESS FOR PRODUCING HIGH TOUGHNESS, HIGH STRENGTH STEEL HAVING EXCELLENT RESISTANCE TO STRESS CORROSION CRACKING

BACKGROUND OF THE INVENTION

1. Field of the Invention

The present invention relates to a high toughness, high strength steel having excellent resistance to stress corrosion cracking in a stress-corrosive environment such as seawater or salt water.

2. Description of the Related Art

The growing energy demand of recent years has led to a search for new energy supplies and thus to interest in development of seabed resources and geological surveys of the seabed. This has also stimulated the construction of marine structures and seabed research vessels as well as plans for construction of seabed bases for oil production, etc.

These structures must be free from distortion, failure, etc. caused by wave motion and water pressure and must be of a higher level of safety. Therefore, it is required that materials used for such marine or seabed structures have high weldability, high strength, and high toughness and further have high resistance to stress corrosion cracking under service conditions such as seawater.

Most steel plates used for these structures have a large thickness (t). It is desired that they satisfy specific requirements such as ASTM A20 (General Requirements for Steel Plate for Pressure Vessels), 11, 5, 3, and 12, 1, 4, which oblige that a required value be satisfied at not only the ¼ t position but also the surface portion (test pieces with central axis of position 7 mm from steel plate surface) and the center portion (½ t).

To meet the need for a safer, more reliable steel, development has been made of high strength, low alloy, Ni-containing steels and processes for producing the same. Typical ones are disclosed by U.S. patent application Ser. No. 798,870 to the same assignee, U.S. Pat. No. 4,572,748, and Japanese Unexamined Patent Publication (Kokai) No. 61-272316.

These all use so-called direct quenching in which a steel plate is water-cooled directly after hot rolling. A direct-quenched steel exhibits a higher hardenability than that of a reheat-quenched steel and provides a higher strength but has a poorer toughness.

In U.S. patent application No. 798,870 a steel slab is heated at a very low temperature of 900° C. to 1000° C. and subjected to low temperature hot rolling, then direct quenching followed by tempering, with the result that the effective grain size is refined to obtain a high toughness steel having a high brittle crack arresting capability never achieved by conventional steels. In U.S. Pat. No. 4,572,748, a steel plate is imparted with uniform mechanical properties by suppressing fluctuation along the length by simultaneously cooling the entire steel plate and by suppressing fluctuation along the thickness by controlling the water flow density to minimize the cooling rate difference between the surface and the inside of the steel plate. However, these do not consider the stress corrosion in an environment where contact with salt water occurs, e.g., the stress corrosion of marine structures in seawater, and cannot ensure full safety for marine use.

Japanese Unexamined Patent Publication (Kokai) No. 61-272316 discloses a process for producing steel having good resistance to stress corrosion cracking in seawater, wherein a Ni-containing steel with an Nb additive and having a reduced amount of the impurity elements P, N, and O is hot-rolled and subjected to direct quenching and tempering under appropriate conditions.

To study the stress corrosion cracking of high strength steels, the linear fracture mechanics theory, which employs the stress intensity factor, K value, at the crack tip, has been applied to quantize the fracture behavior of cracks or defects inherent in the material under corrosive environments. A pre-cracked specimen is subjected to a stress corrosion cracking test under an service environment to establish a severe condition at the notch root and accelerate the initiation of delayed failure. A set of dead-weight tests at various K levels is performed under the above condition to obtain $K_{ISCC}$ value (Mode I fracture occurring under plain strain condition), a critical and constant K value at and below which no delayed fracture takes place any longer. The $K_{ISCC}$ value is employed as a criterion to estimate the resistance to stress corrosion cracking.

The above Japanese publication describes an improved $K_{ISCC}$ value of the welding heat affected zone (HAZ) in seawater, which reaches 450 kgf·mm$^{-3/2}$ at highest but is not sufficiently high.

SUMMARY OF THE INVENTION

The present inventors investigated various steels and processes for producing the same to develop a Ni-containing, low alloy steel having resistance to stress corrosion cracking in seawater or salt water, uniform, high strength and toughness, and good weldability. They found that the carbon content significantly influences the resistance to stress corrosion cracking of high strength materials and that the reduction of the carbon content is extremely effective.

The present inventors also found that, though the presence of Nb in steel is advantageous for ensuring high strength, Nb increases the hardness at HAZ to impair the resistance to stress corrosion cracking of HAZ in seawater to a greater extent in comparison with Mo, and an increase of the Mo amount without the Nb addition rather leads to good results.

To ensure the uniformity of mechanical properties throughout a direct-quenched steel plate, a study was carried out on the cooling upon quenching after hot rolling supposing so-called continuous cooling, in which a steel plate is cooled subsequently from the first portion thereof entering a cooling equipment and also a usual industrial cooling free from a limitation of water flow density, for example, roller quenching. This has resulted in the following findings.

A direct-quenched Ni containing low alloy steel plate exhibits, in the direction along the plate thickness;

A. uniform material properties when it contains a relatively large amount of alloying elements and/or has a relatively small thickness such that a quenched structure is completely martensitic even at the center of the plate and B. a marked fluctuation of material properties, wherein toughness is good in the ½ t to ¼ t portion, but is poor at the surface layer portion when the steel plate contains a relatively small amount of alloying elements or has a relatively large thickness such that a quenched structure is partially a mixed martensite and bainite at the ½ t and ¼ t portions and partially martensite at the surface layer portion.

In considering the weldability, it is necessary to impart uniform properties to a steel plate with a relatively small amount of alloying elements such as B. An excellent strength and a toughness which is uniform along the thickness can be obtained by controlling the hot rolling, direct-quenching, and tempering so that the surface layer of the steel plate has an elongated austenite grain with a tempered martensite structure and the central portion of the steel plate has a globular austenite grain with a mixed structure of tempered martensite and lower bainite. Further, even in the case of A above wherein the entire thickness of the steel plate has a martensitic single phase structure which has not heretofore been considered to result in a good toughness, it is possible to obtain a high toughness when hot rolling is controlled to form an elongated and refined austenitic grain.

The fluctuation of material properties in the direction along the plate length can also be suppressed to within an allowable extent of products which meet industrial specifications by controlling the process as follows:

A'. When the steel plate has a chemical composition and a thickness which result in a martensitic structure throughout the plate thickness by quenching, cooling for quenching should be initiated at a temperature of the $A_{r3}$ point thereof or higher.

B'. When the steel plate has a chemical composition and a thickness which result in a partially mixed martensite and bainite structure at the ½ t and ¼ t portions and partially martensite at the surface layer portion, cooling for quenching should be initiated at a temperature of the $A_{r3}$ point thereof or higher at a time 15 to 150 sec, after the hot rolling is completed and the fluctuation of the transformation point is sufficiently stabilized.

Summarizing the above findings in a metallurgical sense, a Ni-containing, low alloy steel having excellent resistance to seawater stress corrosion cracking, uniform and high strength and toughness, and good weldability can be produced by the process of hot rolling a Ni-containing, low carbon, low alloy steel in a controlled manner in a nonrecrystallization temperature region thereof, then direct-quenching and then tempering the steel under an appropriately selected tempering condition.

Based on these findings, the present invention is a process for producing a high toughness, high strength steel having excellent resistance to stress corrosion cracking, including the steps of: preparing a steel slab comprising 0.02 to 0.10 wt % C, 0.50 wt % or less Si, 0.4 to 1.5 wt % Mn, 1.0 to 7.5 wt % Ni, more than 1.0 wt % up to 1.5 wt % Mo, 0.80 wt % or less Cr, 0.01 to 0.08 wt % sol. Al, and the balance of Fe and unavoidable impurities; heating the steel slab to a temperature of from 1000° C. to 1250° C.; hot rolling the heated steel slab at a finishing nip temperature of from 700° C. to 880° C., at a total reduction rate of 40% or more effected at the finishing nip temperature or lower, and at a finishing temperature of 650° C. or higher to provide a steel plate; then quenching the steel plate by initiating water cooling at a temperature of the $A_{r3}$ point thereof or higher and by terminating the water cooling at a temperature of 150° C. or lower; and tempering the quenched steel plate at a temperature of the $A_{c1}$ point thereof or lower.

The steel slab preferably further includes one or more of 1.5 wt % or less Cu, 0.12 wt % or less V, and 0.015 wt % or less Ti.

The steel slab preferably further comprises 0.0050 wt % or less Ca.

The steel slab preferably further comprises one or more of 1.5 wt % or less Cu, 0.12 wt % or less V, and 0.015 wt % or less Ti as well as 0.0050 wt % or less Ca.

Ni is preferably present at an amount of 1.0 wt % or more and less than 5.0 wt % in the steel slab when a plate thickness of less than 50 mm or a tensile strength of less than 105 $kgf/mm_2$ is desired.

Conversely, Ni is preferably present at an amount of from 5.0 wt % to 7.5 wt % in the steel slab when a plate thickness of 50 mm or more or a tensile strength of 105 $kgf/mm_2$ or more is desired.

Mo is preferably present at an amount of from 1.1 to 1.5 wt %, in the steel slab.

The quenching is initiated by the water cooling preferably at a time 15 to 150 sec after the hot rolling is completed at the finishing temperature.

DETAILED DESCRIPTION OF THE INVENTION

The steel slab used in the process according to the present invention has the component elements and amounts of such component elements as described below.

Figure 1:
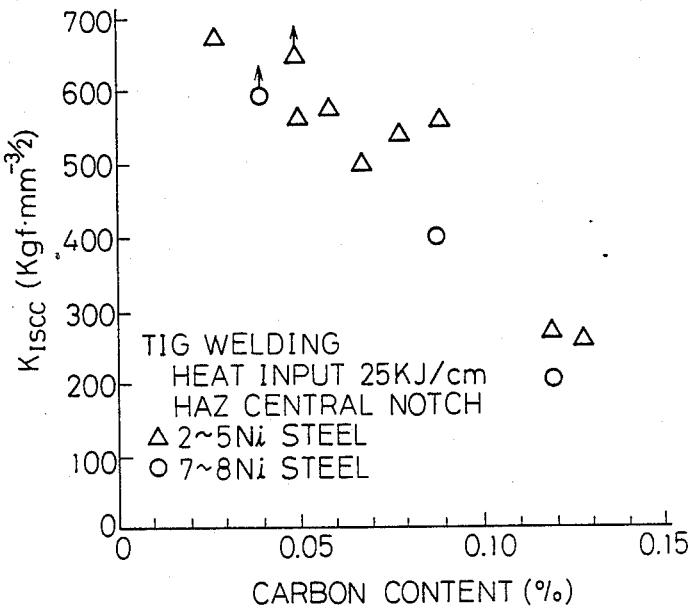
FIG. 1 shows the influence of the carbon content on the $K_{ISCC}$ value at the welding heat affected zone (HAZ) of a Ni-containing high strength steel.

Carbon is effective for increasing the strength through improving hardenability upon quenching, but affects most the resistance to stress corrosion cracking, the improvement of which is an essential object of the present invention. From FIG. 1, which shows the relationship among the resistance to stress corrosion cracking $K_{ISCC}$, at the welding heat affected zone (HAZ), and the carbon content for a Ni-containing, high strength steel, it is understood that the $K_{ISCC}$ value increases as the carbon content decreases. A carbon content exceeding 0.10 wt % remarkably increases the hardness and in turn sharply decreases the resistance to stress corrosion cracking, i.e., the $K_{ISCC}$ value. A carbon content below 0.02 wt % results in insufficient strength. Therefore, carbon must be present in the steel at an amount of from 0.02 to 0.10 wt %.

Silicon is effective for increasing the strength generally but an excessive amount of silicon decreases the cryogenic toughness by increasing the sensitivity to temper embrittlement of Ni-containing steels. The specific upper limit of the silicon content is 0.50 wt % and is intended to ensure sufficient strength and also to prevent a drop in the notch toughness.

Manganese increases the hardenability upon quenching to ensure strength and toughness but, if excessively present increases the sensitivity to temper embrittlement as does silicon. The specified lower and upper limits of the manganese content, 0.4 and 1.5 wt %, can ensure the strength and toughness and suppress the temper embrittlement, respectively.

Nickel improves the cryogenic toughness of steel since it increases the stacking fault energy to promote cross slip, causing stress relaxation with a resulting increase in the absorbed impact energy. Nickel also improves the strength by enhancing the hardenabilty. The nickel content is generally selected in accordance with the desired strength and toughness of steel and, in a steel according to the present invention, must be 1.0 wt % or more to meet the presence of other component elements. The hot rolling of the present invention performed in the nonrecrystallization temperature region can provide a high toughness with a nickel content up to 7.5 wt %. Therefore, the nickel content of the steel used for the process according to the present invention is specified within the range of from 1.0 to 7.5 wt %.

Preferably, nickel should be present at an amount of 1.0 wt % or more and less than 5.0 wt % when a plate thickness of less than 50 mm or a tensile strength of less than 105 kgf/mm$^2$ is desired Conversely, nickel should preferably be present at an amount of from 5.0 to 7.5 wt % when a plate thickness of 50 mm or more or a tensile strength of 105 kgf/mm$^2$ or more is desired.

Molybdenum improves the hardenability to ensure the strength and prevents temper embodiment. Molybdenum is particularly effective for the process according to the present invention wherein hot rolling is performed in the nonrecrystallization temperature region, since it expands the nonrecrystallization temperature region of the steel. Moreover, molybdenum is more advantageous in comparison with niobium for improving the resistance to stress corrosion cracking, since it increases the strength without an excessive increase in the hardness of HAZ. Molybdenum must be present at an amount of more than 1.0 wt % to ensure the strength. However, a molybdenum content exceeding 1.5 wt % increases the amount of coarse carbide particles such as $Mo_2C$ causing a toughness drop and also remarkably hardens HAZ.

Figure 2:
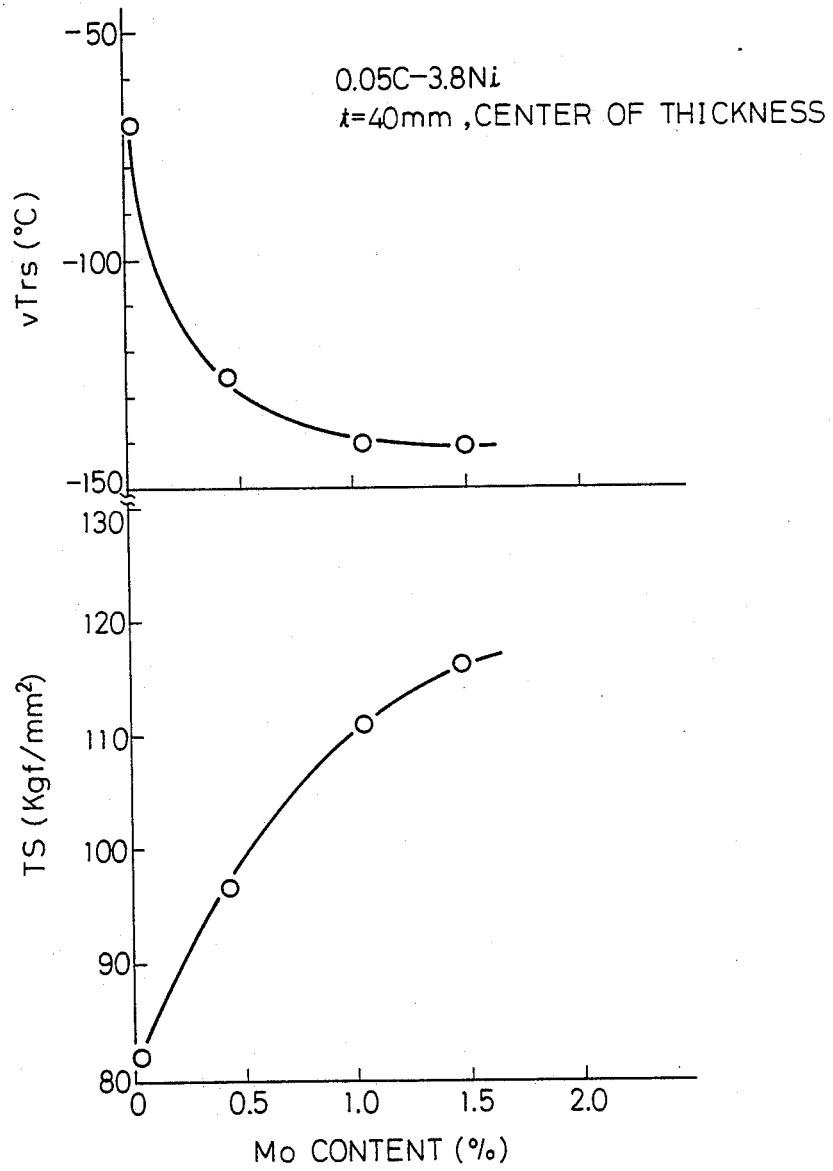
FIG. 2 shows the influence of the molybdenum content on the strength and the toughness in the tempered state.

The direct-quenching process according to the present invention enables solution quenching with the result that the molybdenum content can be increased up to 1.5 wt %, which has not been achieved by ordinary reheat quenching wherein a reheating temperature is limited to about 930° C. to avoid austenite grain coasening during reheating. The increased molybdenum content remarkably enhances both the strength and toughness, as illustrated in FIG. 2.

The molybdenum content range thus specified is above 1.0 to 1.5 wt %. From FIG. 2, it is also understood that the molybdenum is preferably present at an amount of from 1.1 to 1.5 wt %.

Chromium improves the hardenability to ensure the strength but must be limited to an amount of 0.80 wt % or less since an excessive amount increases the hardness of HAZ to lower the $K_{ISCC}$ value.

The above-described component elements are essential to the present invention, while the following elements can be selectively used as additives to further improve the strength and the toughness.

Copper increases the strength as well as improves the corrosion resistance without lowering the toughness and can be added at an amount up to 1.5 wt %. More impairs the hot workability and the toughness.

Vanadium is effective to ensure the strength through precipitation of carbonitrides formed during tempering and can be added at an amount up to 0.12%. More impairs the toughness.

Titanium is effective to prevent the grain coarsening of the welded portion and can be added at an amount up to 0.015 wt %. More impairs the toughness of the base metal.

These additives enhance the strength and the toughness, while the anisotropy and anti-lameller tearing property are improved by the addition of calcium.

Calcium is extremely effective for spheroidizing the nonmetallic inclusions to improve toughness and to minimize the anisotropy in toughness. However, the amount of calcium added must be limited to 0.0050 wt % or less since an excessive amount lowers toughness due to an increase of the inclusion amount.

Phosphorus, sulfer, nitrogen, and other impurities impair the properties of the steel according to the present invention, especially the toughness, and should be removed as far as possible. Preferably, amounts of phosphorus, sulfer, and nitrogen are controlled to 0.010 wt % or less, 0.005 wt % or less, and 0.006 wt % or less, respectively.

According to the present invention, a steel slab having the above-described composition is prepared and subjected to the steps of: heating the steel slab to a temperature of from 1000° C. to 1250° C.; hot rolling the heated steel slab at a finishing nip temperature of from 700° C. to 880° C., at a total reduction rate of 40% or more effected at the finishing nip temperature at a finishing temperature of 650° C. or higher, to provide a steel plate; then quenching the steel plate by initiating water cooling at a temperature of the $A_{r3}$ point thereof or higher and by terminating the water cooling at a temperature of 150° C. or lower; and tempering the quenched steel plate at a temperature of the $A_{c1}$ point thereof or lower.

The reason for the limitations in these steps will now be described.

The steel slab may be prepared either by continuous casting or by ingot-casting and slabbing. Prior to the following heating step, the steel slab may be optionally subjected in accordance with need to a pre-treatment wherein a heating-and-cooling cycle is repeated to diffuse those elements which have a tendency to segregate.

In the heating at a temperature of from 1000° C. to 1250° C., carbonitrides of Mo, V, and the like present in the steel slab must be sufficiently dissolved in the solid solution in order to strengthen the final steel plate by the refinement of austenite grains under the heating temperature and also by the precipitation of fine carbonitride particles of Mo, V, etc. during tempering. A heating temperature below 1000° C. cannot effect the dissolution sufficiently and the presence of undissolved precipitates such as $M_6C$ causes insufficient precipitation hardening during tempering and a toughness drop. Conversely, a heating temperature above 1250° C. can effect sufficient dissolution of carbonitrides of Mo, V, etc. but, in the Ni-containing steel according to the present invention, increases the oxide formed on the steel slab surface, resulting in surface defects of a hot rolled steel plate. The higher heating temperature also coarsens the heated austenite grains which cannot easily be refined during the subsequent hot rolling and causes a toughness drop. Considering these points, the heating temperature of the steel slab is specified as 1000° C. to 1250° C.

Direct quenching according to the present invention may be effected either in a static manner wherein the entire steel plate is simultaneously cooled or in a so-called continuous manner wherein the steel plate is cooled subsequently from the portion entering a cooling equipment. The cooling water flow density is not particularly critical, and the full capacity of the cooling equipment may be used. This is advantageous in that the processed tonnage per unit time can be increased, with a resulting reduction in costs. With the described cooling, the hot rolling can be controlled to obtain uniform material properties of the steel sheet product.

The hot rolling is effected under controlled conditions, that is, a steel slab heated to a temperature of from 1000° C. to 1250° C. is hot rolled at a finishing nip temperature of from 700° C. to 880° C., at a total reduction rate of 40% or more effected at the finishing nip temperature or lower and at a finishing temperature of 650° C. or higher, to provide a steel sheet.

The term "finishing nip temperature" means a temperature at which a material being hot rolled enters and is nipped by the first roll of a series of finishing rolls or the single finishing roll.

The term "total reduction rate" means a sum of reduction rate defined by $(t_0-t)/t_0\times 100$ (%), $t_0$ and t being plate thicknesses at the initiation and the completion of hot rolling in a controlled manner, respectively.

The term "finishing temperature" means a temperature at which a hot rolling step is completed.

The reason for limiting the hot rolling condition will now be described.

As mentioned before, a steel plate after tempering exhibits a high toughness when a martensite phase transformed from the elongated fine austenite grains covers the entire thickness of the steel plate in the case where combination of composition and thickness (cooling rate) of the steel plate leads to a quenched structure of single artensite down to the center portion of the steel thickness, or else covers just the surface layer portion of the steel plate in the case where the combination leads to a quenched structure partially of a mixed martensite and bainite structure at the ½ t and ¼ t portions and of a martensite structure at the surface layer portion. This is due to fine effective grains of the tempered martensite transformed from the elongated fine austenite grains. Therefore, the selection of the above-mentioned hot rolling condition enables a high and uniform strength and toughness throughout the steel plate thickness.

The elongated fine austenite grains are accompanied by formation of a deformation band, with a resulting increase of dislocation density, which is advantageous to achieve an effective precipitation strengthening due to a preferential precipitation of carbonitrides at dislocations during tempering.

A finishing nip temperature exceeding 880° C. falls within the recrystallization temperature region wherein the formation of the elongated fine austenite grains and deformation band is insufficient, with the result that sufficient precipitation strengthening cannot be obtained through the subsequent quenching (i.e., water cooling) and tempering. A finishing nip temperature lower than 700° C. excessively increases the deformation resistance of steel during the rolling and the hot rolling becomes very difficult. Thus, the finishing nip temperature is specified at a temperature of from 700° C. to 880° C. The finishing nip temperature is preferably 700° C. to 850° C.

Figure 3:
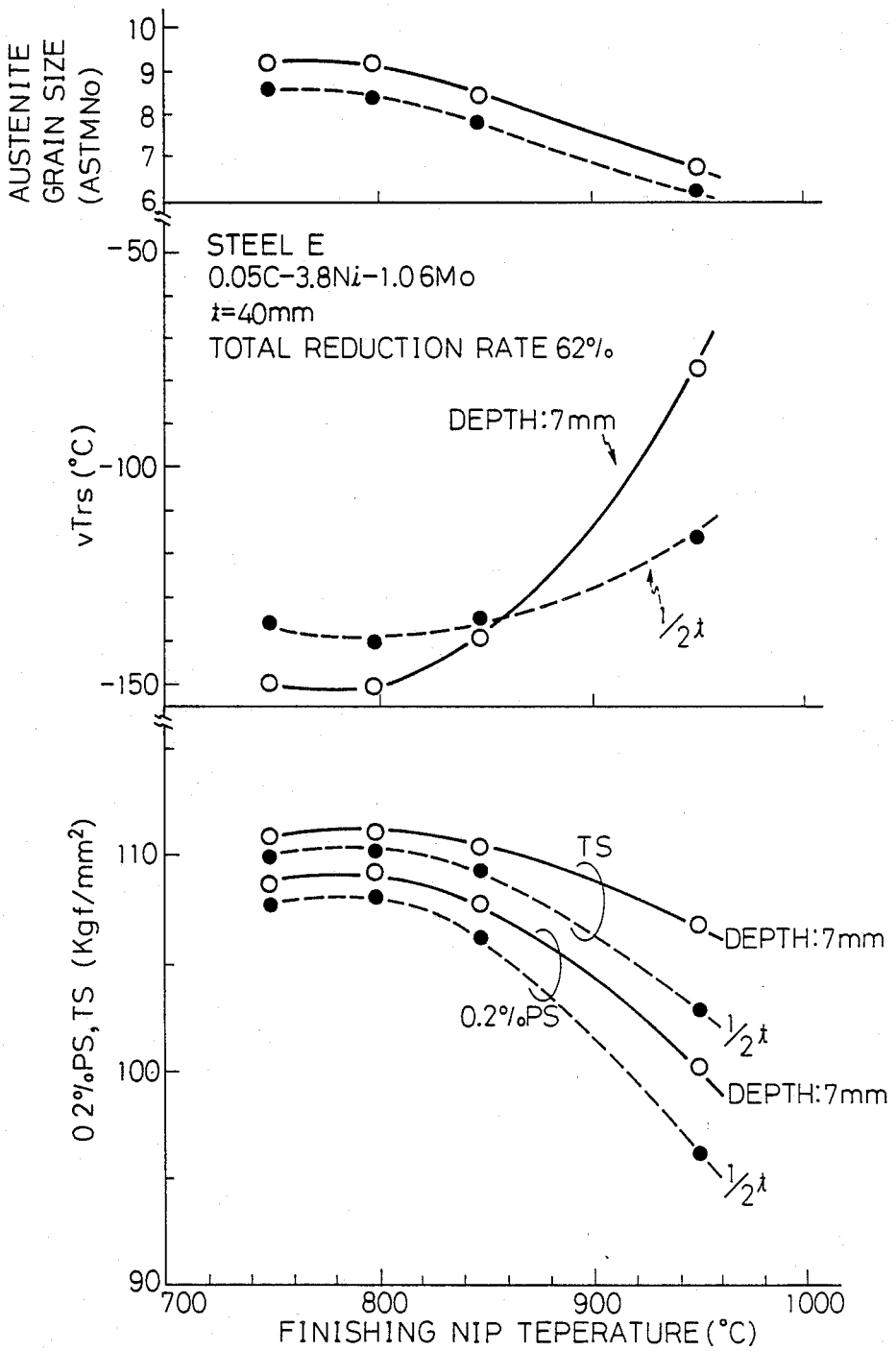
FIG. 3 shows the influence of the finishing nip temperature on the strength and the toughness in the tempered state.

From FIG. 3, which shows the influence of the finishing nip temperature on the strength and toughness after tempering and the austenite grain size, it is understood that, as the finishing nip temperature is lowered, the austenite grains are refined and the strength and the toughness increase.

The total reduction rate effected at and lower than the finishing nip temperature is specified at 40% or more in order to further promote the refinement of austenite grains and the formation of the deformation band.

The finishing temperature must be 650° C. or higher since a temperature lower than 650° C. raises the $A_{r3}$ point of steel and thereby causes a decreased hardenability.

Here, the "transfer time" is defined as a time interval from the completion of hot rolling to the initiation of water cooling, i.e., quenching.

The quenching may be effected immediately after the hot rolling completion (i.e., the transfer time is shorter than 15 seconds) when the quenched structure is to be martensite throughout the plate thickness. Otherwise, a transfer time of a certain duration should preferably be adopted before the water cooling initiation since the quenched structure and the as-quenched hardness are unstable due to the remaining hot working strain and the resulting rise of transformation point, etc. However, an excessive transfer time lowers the temperature of the steel plate to below the transformation point. The transfer time is preferably 15 to 150 sec.

Figure 4:
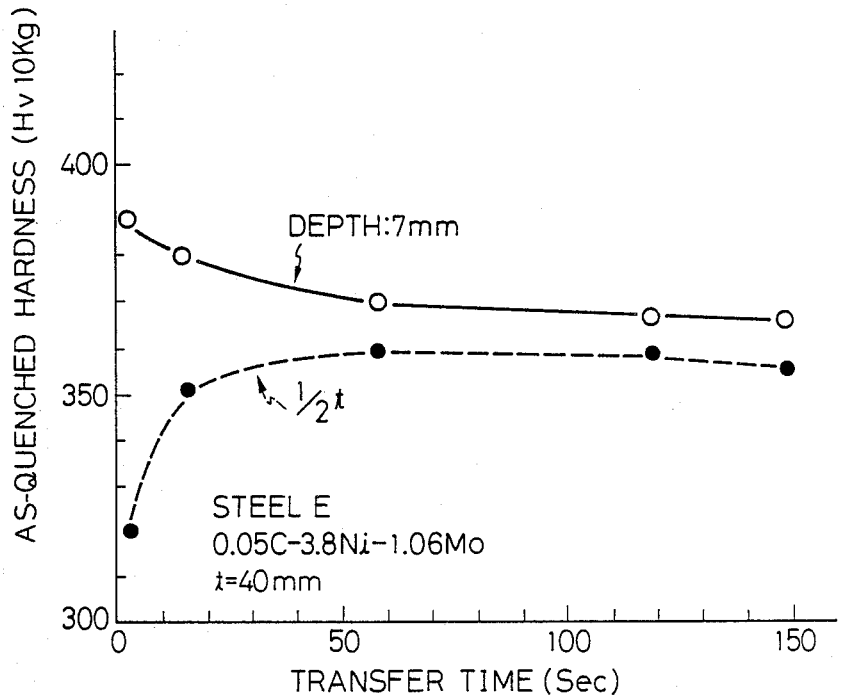
FIG. 4 shows the influence of the transfer time on the hardness in the as-quenched state.

Referring to FIG. 4, which shows an example of the relationship between the as-quenched hardness and the transfer time, it is understood that the as-quenched hardness is stabilized when the transfer time is 15 sec or longer.

The quenching is then effected by initiating water cooling at a temperature of the $A_{r3}$ point of the steel plate or higher and terminating the water cooling at a temperature of 150° C. or lower in order to obtain a sufficient martensite structure. A water cooling initiation temperature below the $A_{r3}$ point causes the partial decomposition of austenite to ferrite, carbides, etc. before the martensitic transformation starts. A water cooling termination temperature higher than 150° C. may cause incomplete martensitic transformation, with a certain amount of untransformed austenite retained, which lowers the yield strength of the steel plate.

Figure 5:
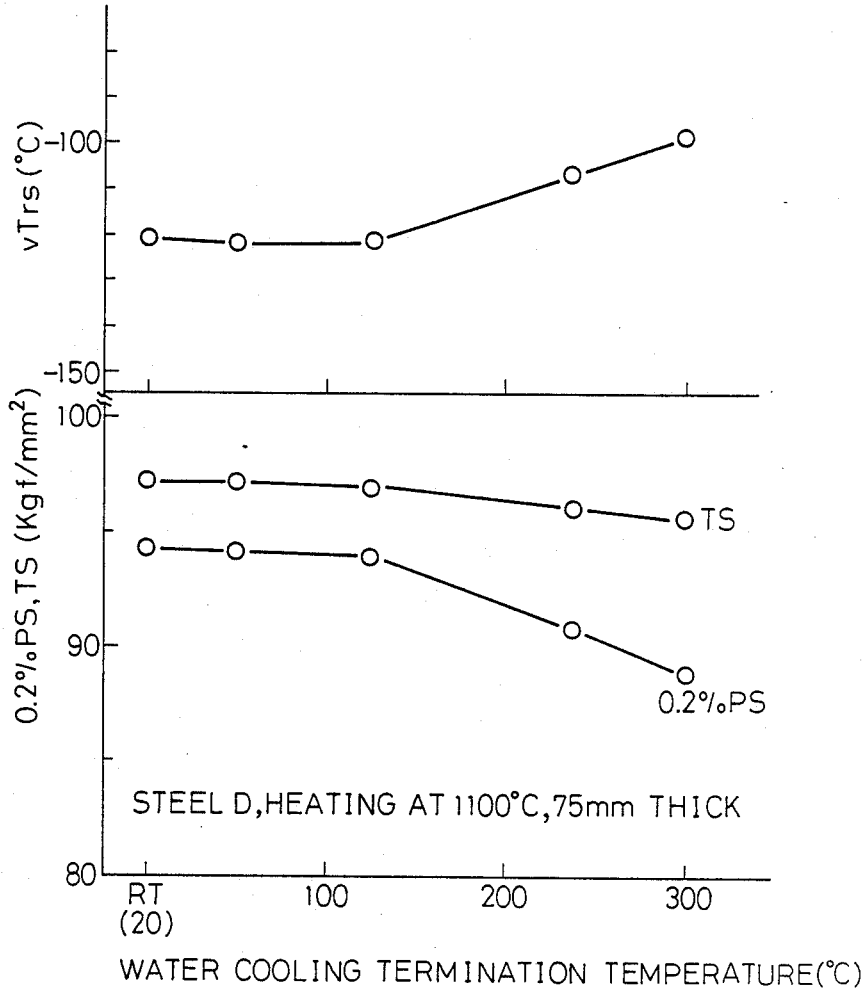
FIG. 5 shows the influence of the water cooling termination temperature on the strength and the toughness in the tempered state.

Referring to FIG. 5, which shows the influence of the water cooling termination temperature on the strength and the toughness, it is understood that the yield strength is improved by lowering the water cooling termination temperature.

After the termination of water cooling, the steel plate must be tempered at a temperature of the $A_{c1}$ point thereof or lower. A tempering temperature exceeding the $A_{c1}$ point impairs the toughness due to the precipitation of unstable austenite. The specified tempering temperature, not higher than the $A_{c1}$ point, allows sufficient precipitation of carbonitrides of Mo, V, etc. which have been dissolved in solid solution with the result that the strength and the toughness are sufficiently ensured.

The steel produced by a process according to the present invention has a high strength and a high toughness even with the low carbon content, and also has an extremely improved $K_{ISCC}$ value.

EXAMPLES

The present invention will be further described with reference to the following examples.

Steel slabs having the compositions shown in Table 1 were subjected to the inventive and comparative processes shown in Table 2 to produce steel plates 40 to 130 mm thick. The steel plates were subjected to a mechanical test of base metal and to a $K_{ISCC}$ test of HAZ. Welding was performed by TIG welding, submerged arc welding, etc. at a heat input of from 25 to 50 kJ/cm. The $K_{ISCC}$ test was performed by using a test piece specified by ASME E399 in 3.5% artificial seawater. The results are summarized in Table 3.

The steels I, J, K, and L have compositions outside the specified composition range according to the present invention, as seen from Table 1.

Table 3 shows that the steel plates produced according to the present invention, in comparison with the steel plates produced by the comparative processes, have a higher strength and a higher toughness at all positions along the plate thickness as well as a higher $K_{ISCC}$ value, which is an objective of the present invention.

TABLE 1

| | Steel | C | Si | Mn | Ni | Mo | Cr | sol Al | Cu | V | Ti | Ca | P | S | N | Ceq*1 | (wt %) Pcm*2 |
|---|---|---|---|---|---|---|---|---|---|---|---|---|---|---|---|---|---|
| Invention | A | 0.03 | 0.20 | 0.48 | 1.05 | 1.32 | 0.35 | 0.035 | 0.53 | — | 0.008 | — | 0.004 | 0.001 | 0.0025 | 0.58 | 0.22 |
| | B | 0.04 | 0.18 | 0.52 | 6.90 | 1.05 | 0.28 | 0.35 | — | — | — | — | 0.006 | 0.001 | 0.0037 | 0.63 | 0.27 |
| | C | 0.08 | 0.24 | 0.53 | 1.04 | 1.12 | 0.51 | 0.028 | — | 0.090 | — | — | 0.003 | 0.001 | 0.0022 | 0.59 | 0.24 |
| | D | 0.05 | 0.10 | 0.50 | 4.10 | 1.01 | 0.45 | 0.035 | 0.26 | — | — | 0.0030 | 0.004 | 0.003 | 0.0035 | 0.58 | 0.26 |
| | E | 0.05 | 0.20 | 0.53 | 3.75 | 1.06 | 0.50 | 0.030 | — | 0.046 | — | — | 0.007 | 0.001 | 0.0034 | 0.60 | 0.24 |
| | F | 0.07 | 0.23 | 0.56 | 5.08 | 1.12 | 0.38 | 0.025 | — | 0.050 | — | — | 0.003 | 0.001 | 0.0028 | 0.66 | 0.29 |
| | G | 0.07 | 0.13 | 0.51 | 2.30 | 1.10 | 0.35 | 0.028 | — | 0.045 | 0.010 | 0.0023 | 0.005 | 0.002 | 0.0042 | 0.57 | 0.23 |
| | H | 0.06 | 0.15 | 0.58 | 2.51 | 1.40 | 0.42 | 0.038 | — | 0.080 | — | — | 0.005 | 0.001 | 0.0030 | 0.67 | 0.26 |
| Comparative | I | 0.06 | 0.25 | 0.69 | 3.85 | 0.47 | 0.60 | 0.032 | — | 0.055 | — | — | 0.007 | 0.001 | 0.0032 | 0.52 | 0.23 |
| | J | 0.12 | 0.05 | 0.58 | 5.03 | 0.60 | 0.58 | 0.036 | — | 0.060 | — | — | 0.006 | 0.001 | 0.0036 | 0.61 | 0.31 |
| | K | 0.13 | 0.25 | 0.63 | 3.55 | 0.51 | 0.54 | 0.029 | — | 0.050 | — | — | 0.008 | 0.002 | 0.0040 | 0.57 | 0.30 |
| | L | 0.12 | 0.08 | 0.55 | 8.35 | 1.10 | 0.52 | 0.032 | — | 0.048 | — | — | 0.004 | 0.001 | 0.0028 | 0.80 | 0.39 |

*1Ceq = C + Si/24 + Mn/6 + Ni/40 + Cr/5 + Mo/4 + V/14 (%)
*2Pcm = C + Si/30 + Mn/20 + Cu/20 + Ni/60 + Cr/20 + Mo/15 + V/10 + 5B (%)

TABLE 2

| | Process No. | Heating, Hot-Rolling Water Cooling (Direct Quenching) Conditions: Slab Heating Temperature (°C.) | Finishing Nip Temperature (°C.) | Total Reduction Rate (%) | Finishing Temperature (°C.) | Water Cooling Initiation Temperature (°C.) | Water Cooling Termination Temperature (°C.) | Tempering Condition: Tempering Temperature (°C.) |
|---|---|---|---|---|---|---|---|---|
| Invention | 1 | 1200 | 850 | 70 | 830 | 815 | Room Temperature | 615 |
| | 2 | 1100 | 750 | 60 | 730 | 710 | Room Temperature | 600 |
| | 3 | 1000 | 850 | 67 | 825 | 815 | Room Temperature | 620 |
| | 4 | 1100 | 830 | 65 | 810 | 805 | 80 | 600 |
| | 5 | 1050 | 800 | 62 | 780 | 765 | Room Temperature | 615 |
| | 6 | 1100 | 830 | 67 | 800 | 785 | Room Temperature | 600 |
| | 7 | 1000 | 830 | 60 | 820 | 810 | 50 | 615 |
| | 8 | 1000 | 800 | 50 | 785 | 780 | Room Temperature | 620 |
| Comparative | 9 | 1050 | 950 | 50 | 920 | 900 | 50 | 620 |
| | 10 | 1100 | 930 | 50 | 900 | 885 | 50 | 600 |
| | 11 | 1050 | 920 | 50 | 895 | 870 | Room Temperature | 600 |
| | 12 | 1100 | 900 | 50 | 880 | 860 | Room Temperature | 600 |
| | 13 | 1100 | 950 | 40 | 935 | 920 | 50 | 600 |
| | 14 | 1100 | 835 | 60 | 820 | 810 | 300 | 600 |
| | 15 | 1050 | 950 | 60 | 925 | 910 | Room Temperature | 615 |

TABLE 3

| | Process No. | Steel | Plate Thickness (mm) | Position Along Thickness | Tensile Property (Base Metal): YS (kgf/mm²) | TS (kgf/mm²) | El. (%) | Impact Toughness (Base Metal): vTrs (°C.) | vE−60 (kgf-m) | $K_{ISCC}$ (HAZ) (kgf · mm$^{-3/2}$) |
|---|---|---|---|---|---|---|---|---|---|---|
| Invention | 1 | A | 60 | S | 96.6 | 99.4 | 25 | −130 | 26.5 | |
| | | | | ¼ t | 96.2 | 99.0 | 25 | −135 | 27.4 | >650 |
| | | | | ½ t | 95.4 | 98.2 | 26 | −110 | 25.8 | |
| | 2 | B | 50 | S | 106.5 | 110.2 | 24 | −150 | 27.2 | |
| | | | | ¼ t | 105.9 | 109.2 | 24 | −140 | 27.5 | >600 |
| | | | | ½ t | 104.3 | 108.5 | 25 | −135 | 28.5 | |
| | 3 | C | 60 | S | 97.8 | 100.2 | 23 | −120 | 23.8 | |
| | | | | ¼ t | 97.5 | 100.0 | 24 | −105 | 23.7 | 550 |
| | | | | ½ t | 95.0 | 98.8 | 23 | −100 | 24.6 | |

TABLE 3-continued

| | Process No. | Steel | Plate Thickness (mm) | Position Along Thickness | Tensile Property (Base Metal) YS (kgf/mm²) | TS (kgf/mm²) | El. (%) | Impact Toughness (Base Metal) vTrs (°C.) | vE−60 (kgf-m) | $K_{ISCC}$ (HAZ) (kgf · mm$^{-3/2}$) |
|---|---|---|---|---|---|---|---|---|---|---|
| | 4 | D | 75 | S | 97.2 | 100.7 | 24 | −130 | 25.2 | |
| | | | | ¼ t | 96.7 | 98.4 | 25 | −120 | 24.1 | 560 |
| | | | | ½ t | 94.3 | 97.2 | 26 | −120 | 24.7 | |
| | 5 | E | 40 | S | 108.7 | 111.2 | 23 | −150 | 28.3 | |
| | | | | ¼ t | 108.2 | 111.0 | 24 | −150 | 27.6 | >650 |
| | | | | ½ t | 106.0 | 110.5 | 24 | −140 | 26.3 | |
| | 6 | F | 50 | S | 110.7 | 113.8 | 25 | −180 | 29.0 | |
| | | | | ¼ t | 109.8 | 113.3 | 25 | −180 | 28.7 | 540 |
| | | | | ½ t | 109.2 | 112.0 | 24 | −170 | 28.2 | |
| | 7 | G | 100 | S | 97.9 | 101.8 | 24 | −120 | 27.1 | |
| | | | | ¼ t | 96.2 | 100.3 | 24 | −110 | 25.2 | 500 |
| | | | | ½ t | 94.8 | 98.1 | 25 | −100 | 25.6 | |
| | 8 | H | 130 | S | 100.8 | 104.6 | 25 | −130 | 26.3 | |
| | | | | ¼ t | 98.2 | 101.7 | 24 | −120 | 27.2 | 510 |
| | | | | ½ t | 96.7 | 100.5 | 25 | −105 | 23.6 | |
| Comparative | 9 | I | 50 | S | 87.2 | 91.4 | 24 | −75 | 10.3 | |
| | | | | ¼ t | 86.7 | 90.2 | 25 | −75 | 11.1 | — |
| | | | | ½ t | 83.5 | 87.2 | 25 | −100 | 22.4 | |
| | 10 | J | 75 | S | 97.4 | 104.2 | 24 | −60 | 9.7 | |
| | | | | ¼ t | 93.8 | 100.5 | 23 | −75 | 12.3 | 290 |
| | | | | ½ t | 90.8 | 97.4 | 23 | −110 | 19.6 | |
| | 11 | K | 40 | S | 94.2 | 100.5 | 24 | −60 | 8.3 | |
| | | | | ¼ t | 93.3 | 99.2 | 25 | −80 | 15.8 | 270 |
| | | | | ½ t | 87.5 | 94.8 | 24 | −100 | 20.2 | |
| | 12 | L | 50 | S | 104.5 | 114.8 | 24 | −70 | 9.2 | |
| | | | | ¼ t | 103.2 | 114.0 | 24 | −80 | 13.8 | 220 |
| | | | | ½ t | 100.2 | 109.4 | 23 | −95 | 20.8 | |
| | 13 | D | 75 | S | 94.4 | 98.6 | 24 | −70 | 7.8 | |
| | | | | ¼ t | 93.3 | 97.2 | 24 | −75 | 8.5 | — |
| | | | | ½ t | 89.4 | 93.1 | 25 | −100 | 21.4 | |
| | 14 | D | 75 | S | 90.8 | 98.7 | 24 | −80 | 14.5 | |
| | | | | ¼ t | 89.7 | 97.5 | 24 | −85 | 15.2 | — |
| | | | | ½ t | 89.0 | 96.1 | 25 | −95 | 19.7 | |
| | 15 | E | 40 | S | 100.5 | 107.4 | 24 | −75 | 12.0 | |
| | | | | ¼ t | 99.3 | 106.7 | 23 | −85 | 16.7 | — |
| | | | | ½ t | 96.8 | 103.2 | 24 | −115 | 23.5 | |

Note:
[1]S in the "Position Along Thickness" column means "Surface Layer Portion", i.e., a position 7 mm deep from plate surface.
[2]Tensile and toughness tests use test pieces sampled in longitudinal direction, i.e., L direction.
[3]$K_{ISCC}$ test pieces are notched and precracked at the center of HAZ and subjected to a dead-weight test in 3.5% NaCl artificial seawater.

We claim:

1. A process for producing a high toughness, high strength steel having excellent resistance to stress corrosion cracking, comprising the steps of:

preparing a steel slab comprising 0.02 to 0.10 wt % C, 0.50 wt % or less Si, 0.4 to 1.5 wt % Mn, 1.0 to 7.5 wt % Ni, more than 1.0 wt % up to 1.5 wt % Mo, 0.80 wt % or less Cr, 0.01 to 0.08 wt % sol. Al, and the balance of Fe and unavoidable impurities;

heating the steel slab to a temperature of from 1000° C. to 1250° C.;

hot rolling the heated steel slab at a finishing nip temperature of from 700° C. to 880° C. at a total reduction rate of 40% or more effected at the finishing nip temperature or lower, and at a finishing temperature of 650° C. or higher, to provide a steel plate;

then quenching the steel plate by initiating water cooling at a temperature of the $A_{r3}$ point thereof or higher and by terminating the water cooling at a temperature of 150° C. or lower; and tempering the quenched steel plate at a temperature of the $A_{c1}$ point thereof or lower.

2. A process according to claim 1, wherein said steel slab further comprises one or more of 1.5 wt % or less Cu, 0.12 wt % or less V, and 0.015 wt % or less Ti.

3. A process according to claim 1, wherein said steel slab further comprises 0.0050 wt % or less Ca.

4. A process according to claim 1, wherein said steel slab further comprises one or more of 1.5 wt % or less Cu, 0.12 wt % or less V, and 0.015 wt % or less Ti as well as 0.0050 wt % or less Ca.

5. A process according to any one of claims 1 to 4, wherein Ni is present at an amount of 1.0 wt % or more and less than 5.0 wt % in said steel slab.

6. A process according to any one of claims 1 to 4, wherein Ni is present at an amount of from 5.0 wt % to 7.5 wt % in said steel slab.

7. A process according to any one of claims 1 to 4, wherein said quenching is initiated by said water cooling at a time 15 to 150 sec after said hot rolling is completed at said finishing temperature.

8. A process according to claim 5, wherein said quenching is initiated by said water cooling at a time 15 to 150 sec after said hot rolling is completed at said finishing temperature.

9. A process according to claim 6, wherein said quenching is initiated by said water cooling at a time 15 to 150 sec after said hot rolling is completed at said finishing temperature.

* * * * *